US006457799B1

(12) United States Patent
Kanome et al.

(10) Patent No.: US 6,457,799 B1
(45) Date of Patent: Oct. 1, 2002

(54) INK-JET PRINTING METHOD AND APPARATUS PRINTING REFERENCE IMAGES FOR DETERMINING CHANGE IN IMAGE QUALITY OVER TIME

(75) Inventors: Osamu Kanome; Takeo Eguchi, both of Yokohama; Kazunori Ueno, Isehara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/982,520

(22) Filed: Dec. 2, 1997

(30) Foreign Application Priority Data

Dec. 2, 1996 (JP) ..... 8-321720

(51) Int. Cl.[7] ..... B41J 29/393
(52) U.S. Cl. ..... 347/19
(58) Field of Search ..... 347/19, 105, 14, 347/107, 5, 15; 358/504, 406, 298; 399/2, 6

(56) References Cited

U.S. PATENT DOCUMENTS

| | | | | |
|---|---|---|---|---|
| 4,202,870 A | | 5/1980 | Weber et al. | 423/630 |
| 4,242,271 A | | 12/1980 | Weber et al. | 260/448 |
| 4,313,124 A | | 1/1982 | Hara | 347/57 |
| 4,345,262 A | | 8/1982 | Shirato et al. | 347/56 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 4,757,334 A | | 7/1988 | Volent | 354/76 |
| 4,816,924 A | | 3/1989 | Sekiya | 358/296 |
| 5,124,732 A | | 6/1992 | Manzer et al. | 346/154 |
| 5,243,394 A | * | 9/1993 | Matsuno et al. | 399/6 |
| 5,451,990 A | * | 9/1995 | Sorenson et al. | 347/19 |
| 5,689,289 A | * | 11/1997 | Watanabe et al. | 347/19 |
| 5,729,785 A | * | 3/1998 | Sakaizawa et al. | 399/2 |
| 5,733,637 A | * | 3/1998 | Moriya et al. | 347/105 |
| 5,798,771 A | * | 8/1998 | Nishii et al. | 347/19 |
| 5,798,773 A | * | 8/1998 | Hiramatsu et al. | 347/19 |

FOREIGN PATENT DOCUMENTS

| | | | |
|---|---|---|---|
| JP | 54-56847 | 5/1979 | |
| JP | 54-59936 | 5/1979 | |
| JP | 59-123670 | 7/1984 | |
| JP | 59-138461 | 8/1984 | |
| JP | 60-71260 | 4/1985 | |
| JP | 7-323573 | 12/1995 | B41J/2/175 |
| JP | 8-2093 | 1/1996 | B41M/5/00 |
| JP | 8-183189 | 7/1996 | B41J/2/21 |
| WO | WO 95/31065 | 11/1995 | |
| WO | WO 96/25719 | 8/1996 | |

OTHER PUBLICATIONS

K. Shirono, "Review for Hydrated Alumina and its Transition States", *Shokubai Kasei Giho*, vol. 2, No. 2, pp. 3–17, 1984.

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

An image is printed in an image print area on a recording medium by using a first printing material. Information is printed on an image preservation determination portion in a border portion as an area other than the image print area by using a second printing material which deteriorates faster than the first printing material. This portion is stored as density data, color appearance data, or the like in the apparatus to be used as a criterion for determination of deterioration when the image is to be reused.

30 Claims, 5 Drawing Sheets

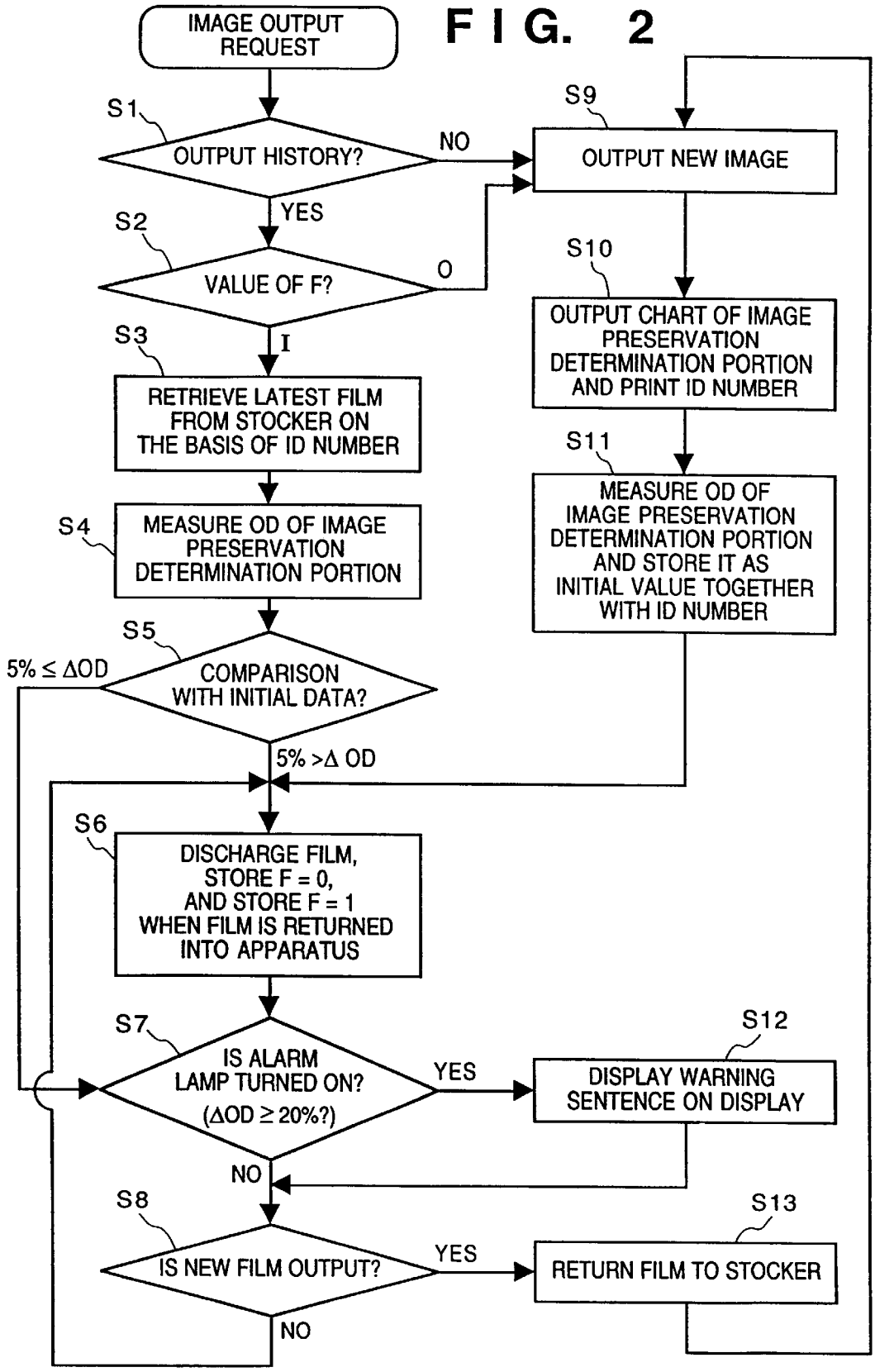
FIG. 2
IMAGE OUTPUT REQUEST
S1
OUTPUT HISTORY?
NO
YES
S2
VALUE OF F?
0
I
S3
RETRIEVE LATEST FILM FROM STOCKER ON THE BASIS OF ID NUMBER
S4
MEASURE OD OF IMAGE PRESERVATION DETERMINATION PORTION
S5
COMPARISON WITH INITIAL DATA?
5% ≤ ΔOD
5% >Δ OD
S6
DISCHARGE FILM, STORE F = 0, AND STORE F = 1 WHEN FILM IS RETURNED INTO APPARATUS
S7
IS ALARM LAMP TURNED ON? (ΔOD ≥ 20%?)
YES
NO
S8
IS NEW FILM OUTPUT?
YES
NO
S9
OUTPUT NEW IMAGE
S10
OUTPUT CHART OF IMAGE PRESERVATION DETERMINATION PORTION AND PRINT ID NUMBER
S11
MEASURE OD OF IMAGE PRESERVATION DETERMINATION PORTION AND STORE IT AS INITIAL VALUE TOGETHER WITH ID NUMBER
S12
DISPLAY WARNING SENTENCE ON DISPLAY
S13
RETURN FILM TO STOCKER

IMAGE PRESERVATION DETERMINATION PORTION

ID NUMBER OR THE LIKE

DISCOLORED IMAGE PRESERVATION DETERMINATION PORTION

INK-JET PRINTING METHOD AND APPARATUS PRINTING REFERENCE IMAGES FOR DETERMINING CHANGE IN IMAGE QUALITY OVER TIME

BACKGROUND OF THE INVENTION

The present invention relates a print method of an ink-jet scheme of performing a print operation by discharging an ink and, more particularly, to a print method of performing multi gradation printing which is used to print a medical image.

As a general method of printing a medical image upon digitalization, a method of using a silver salt printer for outputting an image obtained by exposing a silver salt film with a laser is known.

In the silver salt scheme, wet type printers are often used. Demands, however, have arisen for the development of dry type printers in consideration of liquid waste disposal, cost, and the like. As such printers, printers using the ink-jet print method, e.g., a bubble-jet printer designed to discharge an ink by exerting energy thereon, have been developed.

In this method, two or more types of ink dots having different densities are formed to be stacked on each other in units of pixels to perform a print operation, thereby forming a multi gradation image. For an ink used in an ink-jet printer, a dye or pigment is used as a coloring material. A dye is mainly used in consideration of solubility with respect to water, safety, stability, and the like.

Considering safety in terms of mutagenicity, acute toxicity, and the like, the types of coloring materials (dyes and pigments) which can be used are limited. Of coloring materials, a dye is an organic material, in which C—C double-bonds and N—N double bonds exist in the molecules. For this reason, this material is subjected to deterioration by oxidation, deterioration by UV, and the like. If this ink is exposed to sunlight by accident or left on a desk for a long period of time, the image undergoes color deterioration or color change. As a result, the image cannot be used for a medical examination.

To obtain a stable image, therefore, the image is generally protected by mixing an antioxidant or UV light absorber into an ink or image receiving paper or laminating the image.

It is, however, difficult to completely prevent a change in quality of a dye even by this method. In addition, lamination leads to an increase in cost and requires considerable heat energy.

SUMMARY OF THE INVENTION

The present invention has been made to solve the above problems and, has as its object to provide an ink-jet print method of printing a medical image, in which pieces of information such as a gray scale and the like are printed in a predetermined place other than the effective area of an image with an image preservation determination ink.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 2 is a flow chart showing an image output procedure according to the present invention;

DETAILED DESCRIPTION OF THE PREFERRED EMBODIMENTS

Figure 1:
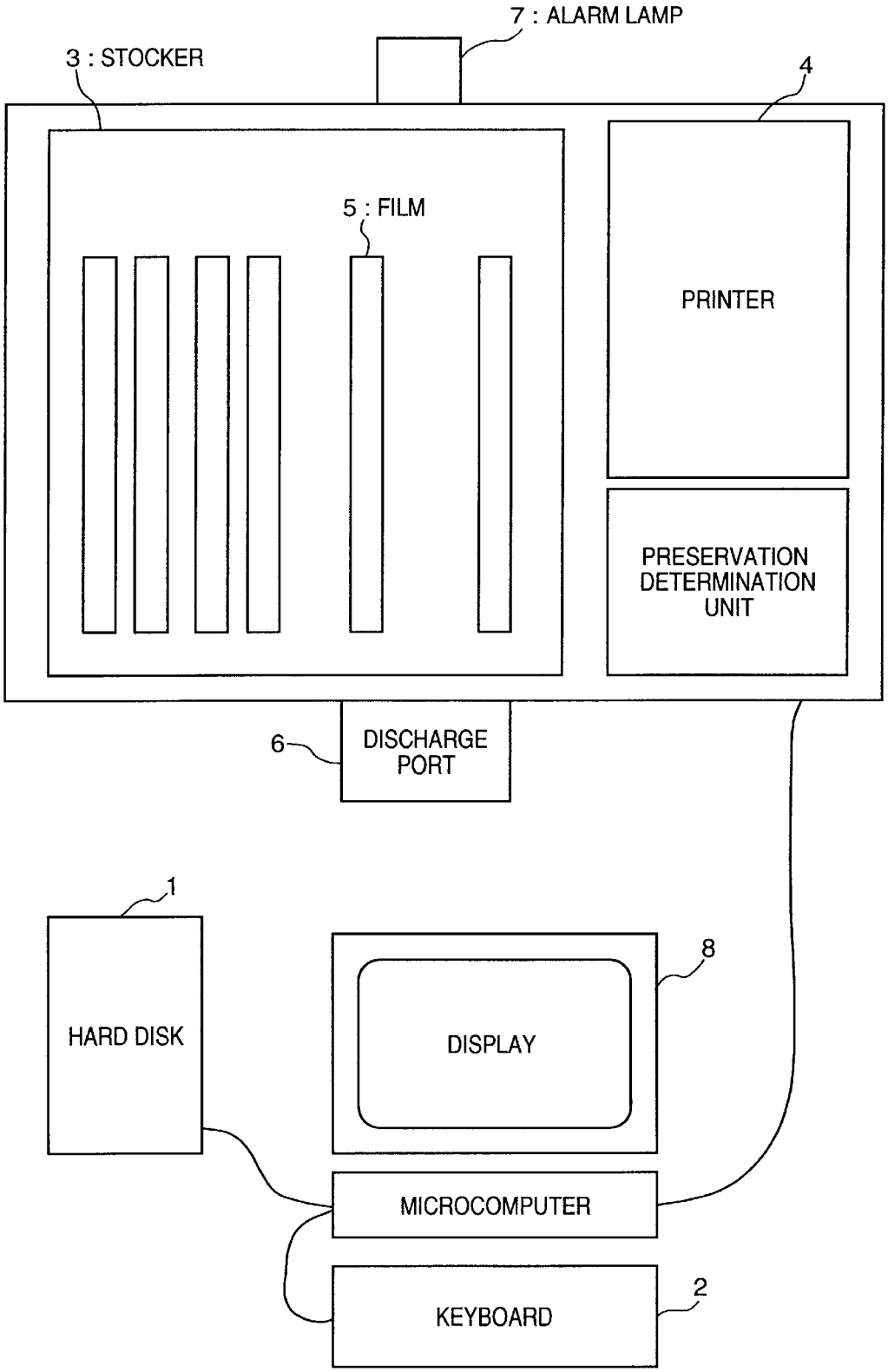
FIG. 1 is a block diagram of an ink-jet print apparatus according to the present invention.

According to the present invention, as described above, in an ink-jet print method of printing a medical image, pieces of information such as a gray scale and the like are printed with an image preservation determination ink in a predetermined place other than the effective area of an image. With these pieces of information, when an image deteriorates due to the color deterioration or color change of a dye, the deterioration can be easily determined. Therefore, this image is not erroneously used for a diagnosis. A criterion for image preservation determination is set such that when the initial optical density (to be abbreviated as OD) of an image changes by 10% or more, the image is determined as a defective image. In this case, patches as a gray scale or the like are formed in advance, from a portion with the lowest OD to a portion with the highest OD, at proper intervals of densities (e.g., 0.5, 1.0, 1.5, 2.0, 2.5, and 3.0), and changes at the respective densities are measured, thereby performing comparison/determination at the respective densities. As the density intervals decrease, the determination precision improves. However, it takes much time. The number of measurement points is therefore preferably set to 10 or less. To increase the determination speed, measurement may be performed at about one to three points in an area where the most noticeable density change has occurred. In this case, the OD range is preferably set from 0.3 to 1.8, and more preferably from 0.5 to 1.5.

Even if the OD of an image does not change much, the color appearance may sometimes change. To determine such a change, a color difference may be used. If, for example, the color appearance is converted into a numerical value by using the L*a*b* calorimetric system (CIE 1976), determination is facilitated.

Conventionally, a silver salt photograph is used as a medical image such as an X-ray photograph. The closer to pure gray the color tone of an image is, the more the image is preferred. A medical image printed by the ink-jet print method, therefore, preferably has a color tone as close to pure gray as possible.

If the color appearance is converted into a numerical value by using L*a*b* (CIE 1976), the value is preferably set within the range given by:

$$0 \leq \sqrt{a'^2 + b'^2}) \leq 10$$

more preferably within the range given by:

$$0 \leq \sqrt{a^{*2}+b^{*2}} \leq 5$$

As a coloring material which can be used in the present invention to print a medical image, any water-soluble dye or pigment written in the color index can be used. As a water-soluble dye, a direct dye, an oxidative dye, a reactive dye, or a basic dye can be used.

Alternatively, even a dye which is not written in the color index can be used as long as it is water-soluble.

For example, direct dyes include CI. Direct Black 17, CI. Direct Black 19, CI. Direct Black 22, CI. Direct Black 32, CI. Direct Black 38, CI. Direct Black 51, CI. Direct Black 71, CI. Direct Black 168, CI. Food Black 2, CI. Direct Yellow 4, CI. Direct Yellow 26, CI. Direct Yellow 44, CI. Direct Yellow 50, CI. Direct Red 1, CI. Direct Red 23, CI. Direct Red 31, CI. Direct Red 37, CI. Direct Red 39, CI. Direct Red 75, CI. Direct Red 80, CI. Direct Red 81, CI. Direct Red 83, CI. Direct Red 225, CI. Direct Red 226, CI. Direct Red 227, CI. Direct Blue 1, CI. Direct Blue 15, CI. Direct Blue 71, CI. Direct Blue 86, CI. Direct Blue 106, and CI. Direct Blue 199.

For example, as the types of oxidative dyes to be used, the following dyes are available: CI. Acid Black 1, CI. Acid Black 2, CI. Acid Black 24, CI. Acid Black 26, CI. Acid Black 31, CI. Acid Black 52, CI. Acid Black 107, CI. Acid Black 109, CI. Acid Black 110, CI. Acid Black 119, CI. Acid Black 154, CI. Acid Yellow 7, CI. Acid Yellow 17, CI. Acid Yellow 19, CI. Acid Yellow 23, CI. Acid Yellow 25, CI. Acid Yellow 29, CI. Acid Yellow 38, CI. Acid Yellow 42, CI. Acid Yellow 49, CI. Acid Yellow 61, CI. Acid Yellow 72, CI. Acid Yellow 78, CI. Acid Yellow 110, CI. Acid Yellow 127, CI. Acid Yellow 135, CI. Acid Yellow 141, CI. Acid Yellow 142, CI. Acid Red 8, CI. Acid Red 9, CI. Acid Red 14, CI. Acid Red 18, CI. Acid Red 26, CI. Acid Red 27, CI. Acid Red 35, CI. Acid Red 37, CI. Acid Yellow 51, CI. Acid Yellow 52, CI. Acid Red 57, CI. Acid Red 82, CI. Acid Red 87, CI. Acid Red 92, CI. Acid Red 94, CI. Acid Red 111, CI. Acid Red 129, CI. Acid Red 131, CI. Acid Yellow 138, CI. Acid Red 186, CI. Acid Red 249, CI. Acid Red 254, CI. Acid Red 265, CI. Acid Red 276, CI. Acid Violet 15, CI. Acid Violet 17, CI. Acid Blue 1, CI. Acid Blue 7, CI. Acid Blue 9, CI. Acid Blue 22, CI. Acid Blue 23, CI. Acid Blue 25, CI. Acid Blue 40, CI. Acid Blue 41, CI. Acid Blue 43, CI. Acid Blue 62, CI. Acid Blue 78, CI. Acid Blue 83, CI. Acid Blue 90, CI. Acid Blue 93, CI. Acid Blue 103, CI. Acid Blue 112, CI. Acid Blue 113, CI. Acid Blue 158, CI. Acid Green 3, CI. Acid Green 9, CI. Acid Green 16, CI. Acid Green 25, and CI. Acid Green 27.

For example, as the types of basic dyes to be used, the following dyes are available: CI. Basic Black 2, CI. Basic Black 8, CI. Basic Yellow 1, CI. Basic Yellow 2, CI. Basic Yellow 21, CI. Basic Orange 2, CI. Basic Orange 14, CI. Basic Orange 32, CI. Basic Red 1, CI. Basic Red 2, CI. Basic Red 9, CI. Basic Red 14, CI. Basic Violet 1, CI. Basic Violet 3, CI. Basic Violet 7, CI. Basic Brown 12, CI. Acid Blue 3, CI. Acid Blue 26, and CI. Basic Green 49.

These dyes can be used singly or in combination. The amount of dye to be added is preferably 0.01 to 15 wt % with respect to the total amount of water-soluble ink.

For example, as the types of pigments to be used, the following pigments are available: inorganic pigments such as loses, barium yellow, prussian blue, cadmium red, titanium oxide, red iron oxide, iron black, and carbon black, and organic pigments such as an azo-based pigment, a phthalocyanine pigment, a nitroso-based pigment, a nitro-based pigment, a basic dye lake pigment, and an oxidative dye lake pigment.

These pigments can be used singly or in combination. The amount of such dye to be added is preferably 0.01 to 15 wt % with respect to the total amount of water-soluble ink.

When a pigment is to be used as a coloring material, a dispersant must be used in consideration of dispersion properties, stability with time, and workability. As a dispersant, a resin-based dispersant, a Nonion-based surfactant, or an anion-based surfactant can be used. Alternatively, a pigment may be chemically modified directly into a water-soluble pigment.

Water is used as a main solvent. The amount of water to be used is preferably 40 to 98 wt % with respect to the total amount of water-soluble ink.

In addition, a water-soluble organic solvent must be used to improve the moisture retention properties and/or discharge stability.

For example, as the types of solvents to be used, the following solvents are available: alcohols such as methanol, ethanol, propanol, isopropanol, butanol, and isobutanol, glycols such as ethylene glycol, diethylene glycol, triethylene glycol, 1.3-butylene glycol, and thiodiglycol, ethylene glycol monoalkylether, ethylene glycol monoethylether, ethylene glycol monobutylether, ethylene glycol monometyletheracetate, dietylene glycol monometylether, dietylene glycol monoethylether, N-methyl-2-pyrrolidone, sorbitol, sorbitan, acetin, and glycerine.

These water-soluble organic solvents can be used singly or in combination. The amount of such solvent to be added is preferably 0.5 to 50 wt % with respect to the total amount of water-soluble ink.

In addition, various types of additives, e.g., an antiseptic/antifungal agent, a humectant assistant such as urea, thiourea, ethylene urea, and their derivatives, an anticorrosive agent for preventing corrosion of metal parts, a surfactant, and an anti-foaming agent, can be selectively used.

As an image preservation determination ink, the same ink as that used to print a diagnosis image can be used. However, since strict gradation preservation is required for a medical image, an ink lower in resistance to light and climate than the ink used to print the medical image is preferably used because such an ink allows detection of a slight deterioration. For example, the image preservation determination ink is preferably higher in rates of change than the image print ink by 5% or more in both a case in which solids are printed on print films at an OD of about 1 with the two types of inks, and are kept for two months under the conditions of 60° C. and 70% RH, and a case in which such solids are kept for 24 hours at an irradiance of 420 $W/m^2$.

More preferably, two types of patches, i.e., patches, as a gray scale or the like, which are formed by using the same ink as that used to print a medical image and patches, as a gray scale or the like, which are formed by using the image preservation determination ink, are formed in a place other than the image print area.

As a recording member to be used in the print method of the present invention, a member obtained by using a film made of a plastic material such as polyester, polypropylene, polyethylene, or polycarbonate as a base member, and forming an ink-receiving layer on the base member is suitably used. As the ink-receiving layer formed on the recording member, a layer is suitably used, which is formed by binding an inorganic porous material such as silica, calcium carbide, magnesium carbide, titania, a white zinc compound, zeolite, vermiculite, diatomaceous, kaolinite, or alumina with a polymeric binder such as polyvinyl alcohol, a conjugated diene-based polymeric latex such as SBR latex, an acrylic polymeric latex, a vinyl-based polymeric latex, starch, casein, soybean protein, or gelatin.

An ink-receiving layer using silica or alumina is especially preferable depending on ink absorbency, uniformity of dot diameters, and the type of coloring material used for an image preservation determination portion because the difference in color deterioration speed between the image preservation determination portion and the medical image print portion can be increased. Of these layers, a layer using pseudo-boehmite is especially preferable.

An alumina hydrate having a boehmite structure and existing in a recording medium of the present invention is defined by the following general chemical formula:

$$Al_2O_{3-n}(OH)_{2n}.MH_2O$$

wherein n is one of the integers, 0, 1, 2, 3, and 0, and m is 0 to 10, and preferably 0 to 5. Since $mH_2O$ indicates an eliminable aqueous phase, m can take a numerical value which is not an integer.

When this type of material is calcined, m can reach a value of 0. Although a method of manufacturing an alumina hydrate having a boehmite structure and contained in a recording medium of the present invention is not specified, the Bayer method, the alum pyrolysis method, or the like can be used. More preferably, a method of hydrolizing long-change aluminum alkoxide by adding an acid thereto is used. If, for example, an alkoxide having five or more carbon atoms, and more preferably, an alkoxide having 12 to 22 carbon atoms, is used, removal of alcohol substances and formation control of an alumina hydrate are facilitated. The above method is superior to a method of manufacturing alumina hydrogel or cationic alumina in that mixing of impurities, e.g., various types of ions, can be suppressed. In addition, since a long-chain aluminum alkoxide facilitates the removal of alcohols after hydrolysis, dealkalization can be completely performed, unlike a case in which a short-chain alkoxide such as aluminum isopropyxide is used.

The alumina hydrate having the boehmite structure, which is obtained by the above method, is subjected to hydrothermal process to grow particles, thereby forming an alumina hydrate solution (aging process). An alumina hydrate powder is then formed by drying the resultant dispersion solution.

An alumina hydrate having a boehmite structure can be identified by the X-ray diffraction method. The alumina hydrate having the boehmite structure and contained in the recording medium which can be used in the present invention provides an X-ray diffraction graphic pattern similar to "Bohmit" shown on the upper right portion in FIG. 7 in "Shokubai Kasei Giho" Vol. 2, No. 2, 1984, p. 11.

An ink-receiving layer can be formed by a method of coating a base member with a dispersion solution containing an alumina hydrate having a boehmite structure as a constituent using a coating apparatus, and drying the solution.

An arbitrary water-soluble polymer can be used as a binder in the present invention. For example, the following polymers are preferably used: polyvinyl alcohol or a denatured polyvinyl alcohol (cation denaturation, anion denaturation, or silanol denaturation), starch or a denatured starch (oxidation or etherification), gelatin or a denatured gelatin, casein or a denatured casein, a cellulose derivative such as carboxymethyl cellulose, gum arabic, hydroxyethyl cellulose, or hydroxypropylmethyl cellulose, a conjugated diene-based polymeric latex such as SBR latex, NBR latex, or a methyl methacrylate-butadiene copolymer, functional group denatured polymeric latex, a vinyl-based copolymeric latex such as an ethylene acetic acid vinyl copolymer, polyvinyl pyrrolidone, maleic anhydride or a maleic anhydride copolymer, and an acrylate ester copolymer. The mixing ratio between an alumina hydrate having a boehmite structure and a binder can be arbitrarily selected from the range of 1:5 to 25:1. If the amount of binder is below the above range, the ink-receiving layer lacks mechanical strength, resulting in cracking or powdering. If the amount of binder exceeds the above range, the pore volume decreases, resulting in poor ink absorbency.

A pigment dispersant, a thickener, a pH adjustor, a lubricant, a fluid denaturant, a surfactant, an anti-foaming agent, a waterproof agent, a foam-inhibitor, a penetrating agent, a coloring dye, a fluorescent brightener, a UV absorbent, an antioxidant, an antiseptic agent, or an antidust agent can be added to a pigment and a binder, as needed.

As a waterproof agent, for example, an arbitrary agent can be selected from known agents such as halogenated tertiary ammonium salt and a tertiary ammonium salt polymer and can be used in combination with a chitosan compound.

As a base member, a paper material such as a properly sized paper sheet, a full-size paper sheet, or a resin-coated paper sheet, a sheet-like material such as a thermoplastic film, or a cloth can be used. As a thermoplastic film, a transparent film such as a film made of polyester, polystyrene, polyvinyl chloride, polymethylmethacrylate, cellulose acetate, polyethylene, or polycarbonate, or an opaque sheet obtained by filling a pigment or forming fine foams can be used.

An ink-jet print scheme will be described next. The ink-jet print method can be applied to any of known ink-jet print schemes of performing print operations by discharging inks from nozzles using various types of driving principles. As a typical example, the ink-jet scheme disclosed in Japanese Patent Laid-Open No. 54-59936 is available. According to this scheme, heat energy is exerted on an ink to abruptly change its volume so as to discharge the ink from nozzles by using the force generated upon this change in state.

Figure 5:
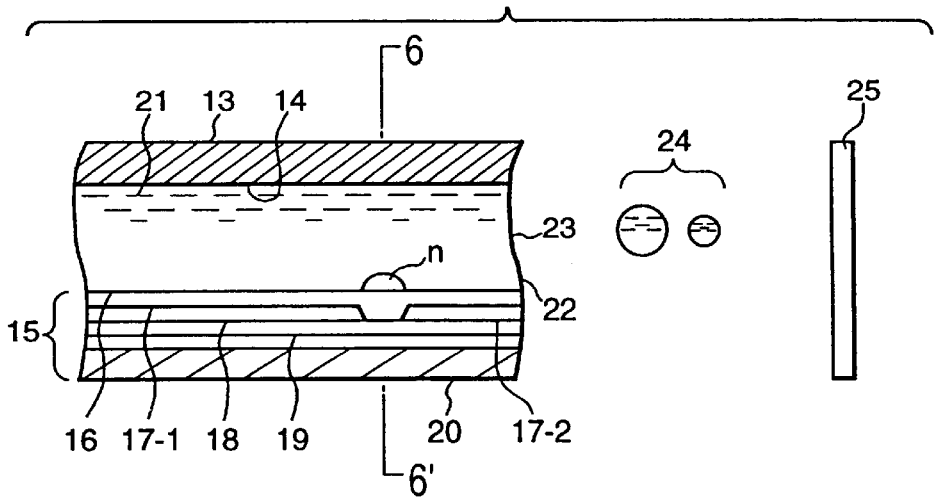
FIG. 5 is a view showing part of the structure of a print head according to the present invention.
Figure 6:
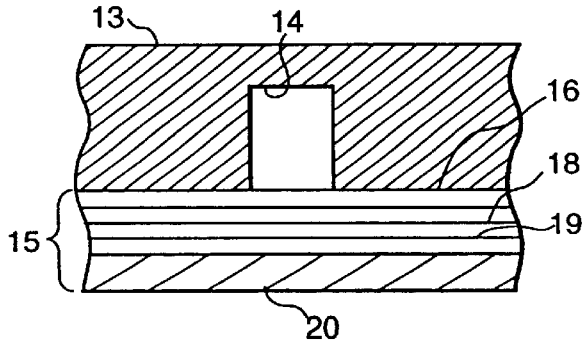
FIG. 6 is a sectional view taken along a line 6–6' in FIG. 5.
Figure 7:
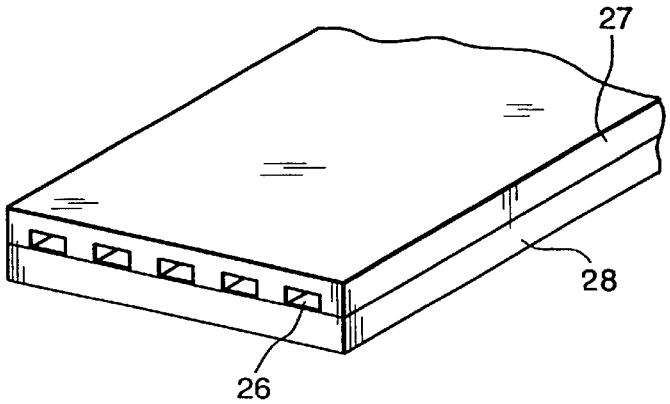
FIG. 7 is a perspective view showing the outer appearance of the print head according to the present invention.

A preferred embodiment of an ink-jet print apparatus suited for the ink-jet print method of the present invention will be described below. FIGS. 5, 6, and 7 show an example of the structure of a head as the main part of the apparatus.

A nozzle 13 of a head is obtained by bonding a glass, ceramic, or plastic plate having a groove 14, through which an ink flows, to a heating head 15 (although FIG. 5 shows the head, the present invention is not limited to this) used for thermal printing. The heating head 15 is constituted by a protective film 16 made of silicon oxide or the like, aluminum electrodes 17-1 and 17-2, a heating resistive layer 18 made of nichrome or the like, a heat accumulating layer 19, and a substrate 20 made of alumina or the like and having good heat dissipation properties.

An ink 21 reaches a discharge orifice (pore) 22, and forms a meniscus 23 with a pressure P.

When an electrical signal is applied to the aluminum electrodes 17-1 and 17-2, an area n of the heating head 15 is quickly heated, and an air bubble is generated in the ink 21 which is in contact with this area. As a result, an ink droplet 24 is formed at the orifice 22 and ejected to a recording sheet 25. FIG. 7 shows the outer appearance of a multi-nozzle having a large number of nozzles, each identical to the one shown in FIG. 5. This multi-nozzle is manufactured by bonding a glass plate 27 having multi-grooves 26 to a heating head 28 similar to the one described with reference to FIG. 5.

FIG. 6 is a sectional view of the head 13 taken along the ink path. FIG. 6 is a sectional view taken along a line 6–6' in FIG. 5.

Figure 8:
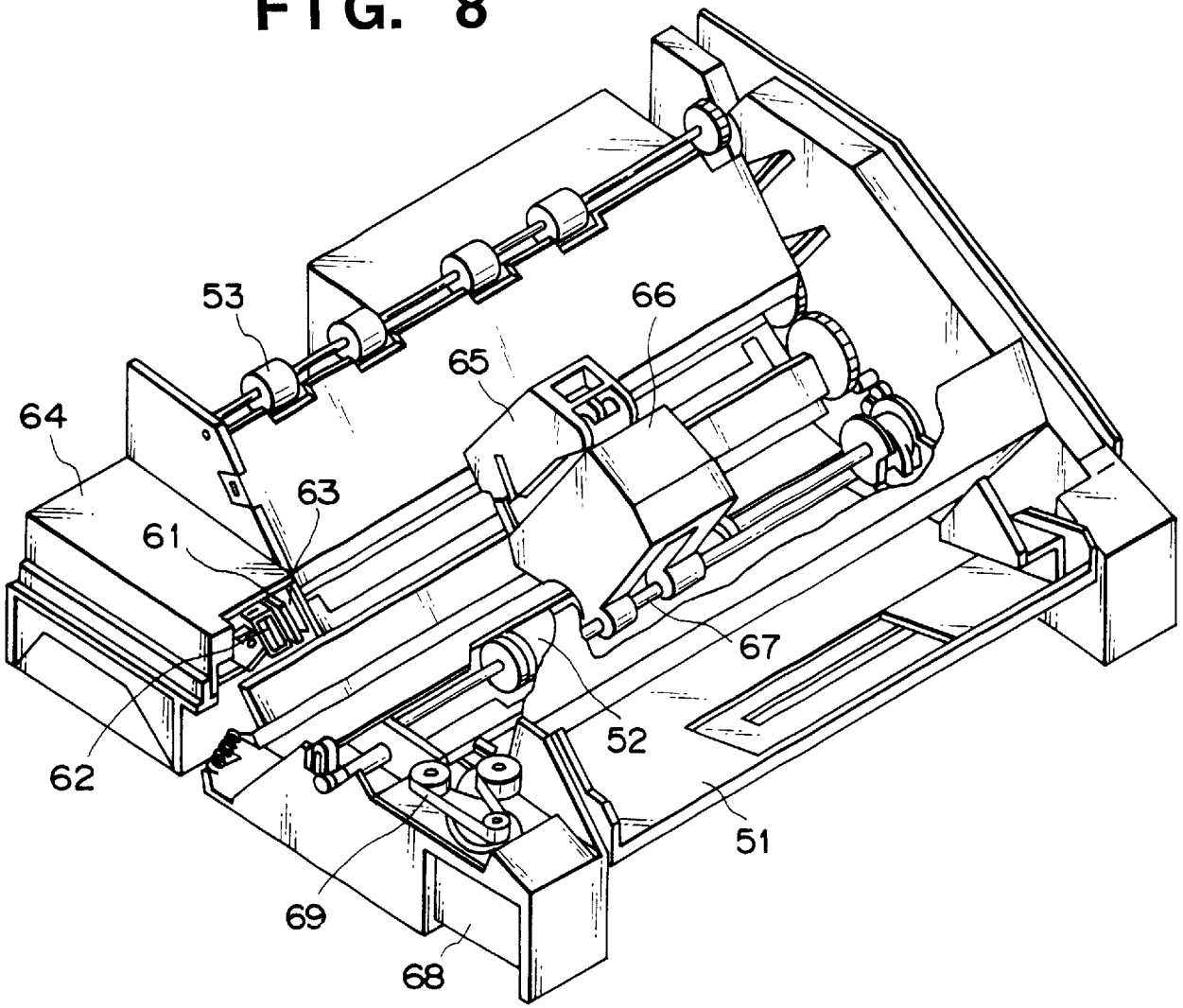
FIG. 8 is a perspective view showing an ink-jet print apparatus according to the present invention.

FIG. 8 shows an example of the ink-jet print apparatus incorporating such a head.

Referring to FIG. 8, reference numeral 61 denotes a blade as a wiping member. One end of the blade 61 is a fixed end held by a blade holding member in the form of a cantilever. The blade 61 is placed nearer to the print area than the print head. In this case, the blade 61 is held to protrude into the path of the print head. Reference numeral 62 denotes a cap, which is placed at a home position adjacent to the blade 61. The cap 62 moves in a direction perpendicular to the moving direction of the print head to come into contact with the discharging opening surface, thereby capping the surface. Reference numeral 63 denotes an ink absorber placed to be adjacent to the blade 61. The blade 61, the cap 62, and the ink absorber 63 constitute a discharge restoring unit 64 to remove the moisture and dust on the ink discharging opening surface by the blade 61 and the ink absorber 63.

Reference numeral 65 denotes a print head having a discharging energy generating means and designed to perform a print operation by discharging an ink to a recording medium opposing a discharging opening surface having discharging openings; and 66, a carriage having the print head 65 mounted thereon and designed to move it. The carriage 66 is slid ably engaged with a guide shaft 67. A portion of the carriage 66 is connected (not shown) to a belt 69 driven by a motor 68. With this structure, the carriage 66 can move along the guide shaft 67 to allow the print head 65 to move to a print area and its adjacent area.

Reference numeral 51 denotes a paper feed unit; and 52, a feed roller. With this structure, a recording medium is fed to a position opposite to the discharging opening surface of the print head. As the print operation proceeds, the recording medium is discharged through discharge rollers 53.

In the above structure, while the print head 65 returns to the home position at the end of a print operation, the cap 62 of the discharge restoring unit 64 is retracted from the path of the print head 65, but the blade 61 is protruding into the path. As a result, the discharging opening surface of the print head 65 is wiped. Note that when the cap 62 comes into contact with the protruding surface of the print head 65 to cap it, the cap 62 moves to protrude into the path of the print head 65.

When the print head 65 moves from the home position to the print start position, the cap 62 and the blade 61 are at the same positions as those in the above wiping operation. As a result, the discharging opening surface of the print head 65 is wiped in the process of this movement.

As described above, the print head moves to the home position at the end of the print operation and in the discharge restoring operation. In addition to this movement, the print head moves to the home position adjacent to a print area at predetermined intervals while the print head moves in the print area to perform a print operation. In the process of this movement, the above wiping operation is performed.

When a color print operation is to be performed, print heads respectively containing black, cyan, magenta, and yellow inks are arranged side by side on the carriage 66. Alternatively, the four print heads may be arranged in a vertical array instead of being arranged side by side.

In addition, inks of three colors, i.e., cyan, magenta, and yellow, may be used instead of inks of the four colors.

To improve the gradation characteristics in printing a medical image, multiple printing may be performed for one dot by using inks having high and low densities. If the amount of ink landed increases, a drying mechanism such as a blower or heater may be used.

The image preservation determination unit incorporates an optical density/color difference detector constituted by a light-emitting element such as a halogen lamp or LED, a light-receiving element such as a CCD or spectral sensor, and a microcomputer. A storage unit such as a hard disk is preferably connected to the microcomputer to store data. If data such as the initial OD, print date, patient name, and the like of each medical image are stored in the storage unit, other medical data can be searched out. In addition, the stored data can be searched out from other terminals. Data such as an ID number may be printed on a peripheral portion such as a portion near the image preservation determination portion of a film in the form of a bar code.

The size of the image preservation determination area of a print needs to be about 3×3 mm for each density in consideration of positioning and measurement stability. Since an excessively large size will interfere with diagnosis, the size is preferably set to be 25×25 mm or less. Alternatively, a gray scale exhibiting a continuous change in density may be printed. In this case, the density data is stored as a profile which continuously changes.

When a medical image is to be output, the corresponding digital data is output after being divided into signals in units of densities. In this case, if a gray scale is also output with an image print ink, together with a gray scale for image preservation determination, the presence/absence of the gradation difference between the original image and the output image can be determined by measuring the gray scale and comparing it with the original data in the image preservation determination unit. If a problem is posed in terms of gradation, an alarming means such as a buzzer or lamp is operated. If no problem is posed, the image is discharged. The read gradation data is stored in the storage unit, together with the ID number. When the image is to be checked after a lapse of a predetermined period of time, whether the image is defective or not can be determined by measuring the gray scale and comparing it with the initial data again in the image preservation determination unit.

The embodiments of the present invention will be described in detail below.

First Embodiment

FIG. 1 is a block diagram showing an apparatus according to the first embodiment of the present invention. A program for managing recording films in accordance with the flow chart of FIG. 2 is installed in the microcomputer of this apparatus. Medical images are stored as digital signals in a hard disk 1. Upon reception of an image retrieval instruction from a keyboard 2, the microcomputer checks the past image output history (step S1). If the image was output in the past (YES in step S1), the film is retrieved from a stocker 3 (step S3). If the image was not output in the past (NO in step S1), a new recording film is retrieved, and the image is output (step S9). In this case, since the image was not output in the past, it is output as a new image, and the image output history count is set as one. The image is output by a printer 4.

The printer 4 contains two types of inks, which were respectively prepared as follows. One type of ink was a medical image print ink using CI. Direct Black 19 as a coloring material. The concentrations of the coloring materials were set to 4.0, 3.0, 1.5, and 0.7 wt %. As humectants, 3.0 wt % of glycerine, 3.0 wt % of ethylene glycol, and 3.0 wt % of urea were added to the coloring material, and the balance was ion exchange water; the total amount was 100 wt %. The other type of ink is an image preservation determination ink, which was prepared by using CI. Direct Black 168 as a coloring material. The concentration of the coloring material was 3.0 wt %. As organic solvents, 3.0 wt % of glycerine, 3.0 wt % of ethylene glycol, and 3.0 wt % of urea were added to the coloring material, and the balance was ion exchange water; the total amount was 100 wt %.

An X-ray photograph was printed on the image print portion of color BJ transparency CF-F301 (tradename; available from CANON INC.) as a recording film, together with five types of 5×5-mm black solids for image preservation determination, which were printed on a border portion of the film, with these inks by using a bubble-jet printer head (40×40 $\mu$m (orifice diameter)×64 (nozzles)×5 (chips)). The measured optical densities of these black solids were 0.49, 1.03, 1.49, 2.02, and 2.51, respectively.

Figure 3:
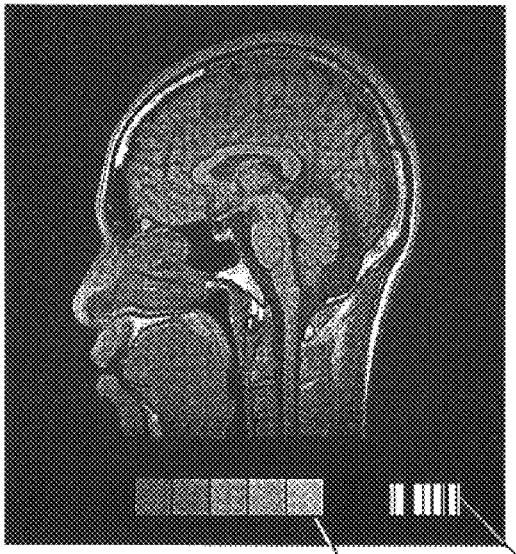
FIG. 3 is a view showing a sample image printed by printing according to the present invention.
Figure 4:
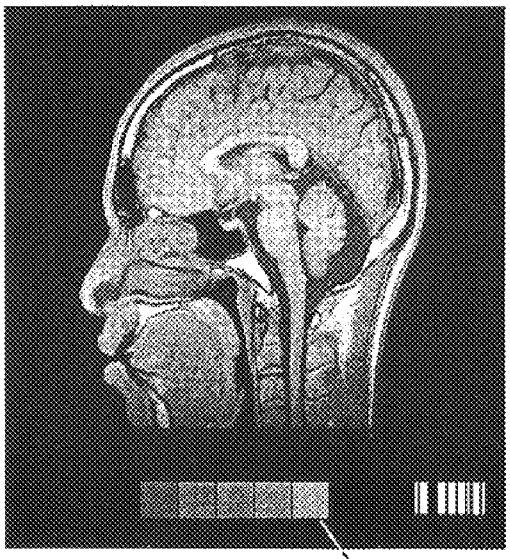
FIG. 4 is a view showing an example of how the image printed by printing according to the present invention deteriorates.

FIGS. 3 and 4 show sample images printed according to the invention. The sample images are medical images with ID numbers and image preservation determination portions on their bottoms.

Both the difference between the OD change rates of CI. Direct Black 19 and CI. Direct Black 168 printed as solids on the CF-F301 with OD=1 after they were kept at 60° C. and 70% RH for two months, and the difference between the OD change rates of similar solids after they were kept at a radiant intensity of 420 W/m$^2$ for 24 hours were 10% or more.

The ID number is also printed as a bar code on the border portion (step S10). These data are stored in the hard disk in the microcomputer (step S11).

A film 5 having undergone a series of operations is discharged from a discharge port 6 (step S6).

The measured optical densities of X-ray photograph portions at five points were 0.52, 1.03, 1.55, 2.22, and 2.85, respectively.

After this recording sheet was left alone in a chamber at 55° C. and 70% RH for three months, the sheet was returned into the apparatus through the discharge port 6. The ID number was read from the film 5 returned into the apparatus, and the film 5 was stored at a predetermined position in the stocker 3.

When an instruction to output this image is input through the keyboard 2 again, since the image output history count is 1, the stocker 3 is searched to take out the film 5 therefrom (step S8). The optical densities of the black solids on the image preservation determination portion of the film 5 are automatically measured (step S4). In this case, the measurement values were 0.43, 0.87, 1.34, 1.83, and 2.31, respectively. When the data were compared with the data in the microcomputer (step S5), the density of some portions changed by 10% or more. An alarm lamp 7 was turned on to warn about the possibility of deterioration (YES in step S7). If the density of some portion has changed by 20% or more, since the possibility of deterioration is high, a warning message is also displayed on a display 8 in a noticeable form (step S12).

Subsequently, whether to output the old film or a new film is selected (step S8). When it is determined that a detailed diagnosis is required, it suffices to select the output of a new film (YES in step S8).

In this case, the old film 5 was taken out to check the degree of deterioration. The measured optical densities of the X-ray photograph portions at the five points were 0.49, 0.98, 1.49, 2.16, and 2.80, respectively. The average optical density decreased by about 3% compared with those before the film was left alone; a slight deterioration had occurred.

Second Embodiment

An image preservation determination ink was prepared as a coloring material by using CI. Food Black 2. The concentration of the coloring material was 4.0 wt %. As organic solvents, 3.0 wt % of glycerine, 3.0 wt % of ethylene glycol, and 3.0 wt % of urea were added to the coloring material, and the balance was ion exchange water; the total amount was 100 wt %.

Solids were printed by using this image preservation determination ink in the same manner as in the first embodiment except that OHP sheet MJOHPSI (tradename) for Mach Jet Color available from EPSON was used.

Both the difference between the OD change rates of CI. Direct Black 19 and CI. Food Black 2 printed as solids on the CF-F301 with OD=1 after they were kept at 60° C. and 70% RH for two months, and the difference between the OD change rates of similar solids after they were kept at a radiant intensity of 420 W/m$^2$ for 24 hours were 8% or more.

This recording sheet was left alone in a room at a position where it was exposed to sunlight through a windowpane for one week, and was then returned into the apparatus. When the operator tried to take out the sheet, the alarm lamp 7 was turned on. When the recording sheet was taken out, and the optical densities of medical image portions were measured, the average optical density was lower than that of the sheet before it was left alone in the room by about 4%.

Third Embodiment

Aluminum dodexide was manufactured by the method disclosed in U.S. Pat. No. 4,242,271. Aluminum alkotoside was hydrolyzed to manufacture an alumina slurry by the method disclosed in U.S. Pat. No. 4,202,870. Water was added to this alumina slurry until an alumina hydrate having a boehmite structure became 7.3%. The pH of the alumina slurry was 9.1. The pH was adjusted by a 3.9% nitrate solution adding to the slurry. A colloidal sol was obtained under the following aging conditions: aging temperature: 147° C.; aging period: seven hours; and aging apparatus: autoclave. An alumina hydrate power having a boehmite structure was formed by performing spray drying with respect to this colloidal sol at 87° C.

In addition, an alumina dispersion solution was formed by mixing 17 wt % of the alumina hydrate having the above boehmite structure into ion exchange water. A PVA solution was formed by mixing 20 wt % of polyvinyl alcohol (Gosenole NH18 to be referred to as PVA hereinafter available from Nihongoseikagaku Kogyo K.K) into ion exchange water. In addition, the alumina dispersion solution and the PVA solution were mixed at 18:1 to form a coating solution. This coating solution was applied onto a polyethylene terephthalate film having a thickness of 188 $\mu$m by using an extrusion coater. This solution was then dried. At this time, the coating weight of the ink-receiving layer was 40 g/cm$^2$.

The recording medium formed in this manner was cut into a half size and used for a print operation.

As a coloring material for an image print ink, a material, obtained by mixing carbon black and CI. Food Black 2 at a ratio of 1:1 was used. As a color material for an image preservation determination ink, CI. Food Black 2 is singly used. Solids of the material obtained by mixing carbon black and CI. Food Black 2 at a rate of 1:1 and CI. Food Black 2 were printed on the CF-301 with OD=1. Both the difference between the OD change rates of these solids after they were kept at 60° C. and 70% RH for two months, and the difference between the OD change rates of the solids after they were kept at a radiant intensity of 420 W/m$^2$ for 24 hours were 5% or more.

An X-ray photographic image was printed with the ink concentration being set in the same manner as in the first embodiment. This recording film was left alone near a copying machine in a room for one week, and was then returned into the apparatus. When the operator tried to take out the film, the alarm lamp 7 was turned on. When the image was retrieved, and the optical densities of medical image portions were measured, the average density was lower than that of the film before it was left alone in the room by about 3%.

As described above, according to the print method of the present invention, in the ink-jet print method of printing a medical image, pieces of information for image preservation determination are printed in a predetermined place other than the effective area of an image, and the corresponding data is stored in the storage unit in the apparatus. When the image is to be used again afterward, this data is compared with the corresponding initial value to detect slight changes that are difficult to discriminate with the naked eye, e.g., color deterioration, color change, and the like of the dye, can be detected. A warning can be generated. Erroneous use of such an image for diagnosis can therefore be prevented. If a perfect image is not required depending on the application purpose of the image, the image can be reused as a reference image, thereby allowing the effective use of the resources.

If a gray scale is used as information for image preservation determination, data before deterioration can be reproduced on the basis of the initial value of the gray scale. Assume that original image data is destroyed. Even in this case, if only the initial value of the gray scale is stored, the original image can be reproduced by reading the image printed on a film with a scanner, performing density correction upon comparison between the current read value from the gray scale with the initial value, and outputting the resultant image from the printer.

If the present invention is used in this manner, the preservation of an image improves. Even if the image deteriorates or the original data is lost for some unexpected reason, the image can be reproduced, and the storage safety improves.

This embodiment is applied to the print apparatus of the system, among various ink-jet print systems, which has a means (e.g., an electrothermal converter or laser light) for generating heat energy as energy used to discharge an ink, and changes the state of the ink by using the heat energy. According to this system, a high-density, high-definition print operation can be realized.

As for the typical structure and principle, it is preferable that the basic structure disclosed in, for example, U.S. Pat. Nos. 4,723,129 or 4,740,796 is employed. The above method can be adapted to both a so-called on-demand type apparatus and a continuous type apparatus. In particular, a satisfactory effect can be obtained when the on-demand type apparatus is employed because of the structure arranged in such a manner that one or more drive signals, which rapidly raise the temperature of an electrothermal converter disposed to face a sheet or a fluid passage which holds the fluid (ink) to a level higher than levels at which film boiling takes place are applied to the electrothermal converter in accordance with print information so as to generate heat energy in the electrothermal converter and to cause the heat effecting surface of the print head to take place film boiling so that bubbles can be formed in the fluid (ink) to correspond to the one or more drive signals. The enlargement/contraction of the bubble will cause the fluid (ink) to be discharged through a discharging opening so that one or more inks are formed. If a pulse shape drive signal is employed, the bubble can be enlarged/contracted immediately and properly, causing a further preferred effect to be obtained because the fluid (ink) can be discharged while revealing excellent responsiveness.

It is preferable that a pulse drive signal disclosed in U.S. Pat. Nos. 4,463,359 or 4,345,262 is employed. If conditions disclosed in U.S. Pat. No. 4,313,124 which is an invention relating to the temperature rising ratio at the heat effecting surface are employed, a satisfactory print result can be obtained.

As an alternative to the structure (linear fluid passage or perpendicular fluid passage) of the print head disclosed in each of the above inventions and having an arrangement that discharge ports, fluid passages and electrothermal converters are combined, a structure having an arrangement that the heat effecting surface is disposed in a bent region and disclosed in U.S. Pat. Nos. 4,558,333 or 4,459,600 may be employed. In addition, the following structures may be employed: a structure having an arrangement that a common slit is formed to serve as a discharge section of a plurality of electrothermal converters and disclosed in Japanese Patent Laid-Open No. 59-123670; and a structure disclosed in Japanese Patent Laid-Open No. 59-138461 in which an opening for absorbing pressure waves of heat energy is disposed to correspond to the discharge section.

Furthermore, as a print head of the full line type having a length corresponding to the maximum width of a recording medium which can be printed by the print apparatus, either the construction which satisfies its length by a combination of a plurality of print heads as disclosed in the above specifications or the construction as a single full line type print head which has integrally been formed can be used.

In addition, the invention is effective for a print head of the freely exchangeable chip type which enables electrical connection to the print apparatus main body or supply of ink from the main device by being mounted onto the apparatus main body, or for the case by use of a print head of the cartridge type provided integrally on the print head itself.

It is preferred to additionally employ the print head restoring means and the auxiliary means provided as the component of the present invention because the effect of the present invention can be further stabilized. Specifically, it is preferable to employ a print head capping means, a cleaning means, a pressurizing or suction means, an electrothermal converter, another heating element or a preheating means constituted by combining them and a pre-discharging mode in which a discharging operation is performed independently from the print operation in order to stably perform the print operation.

In addition, the print apparatus may have at least one of a multi-color mode using different colors and a full-color mode using color mixtures, as well as a print mode using only a main color such as black, with an integral print head or a combination of print heads.

Although this embodiment is based on the assumption that a liquid ink is employed, an ink which solidifies at the room temperature or lower, or an ink which softens or liquifies at the room temperature may be used. In the ink-jet scheme, temperature control is generally performed such that the temperature of an ink itself is adjusted within the range of 30° C. to 70° C. to set the viscosity of the ink within a stable discharge range. That is, any ink which liquifies when a print signal is supplied may be used.

Furthermore, an ink which is solidified when it is caused to stand, and liquified when heat energy is supplied in accordance with a print signal can be adapted to the present invention to positively prevent a temperature rise caused by heat energy by utilizing the temperature rise as energy of state transition from the solid state to the liquid state or to prevent ink evaporation. In any case, an ink which is liquified when heat energy is supplied in accordance with a print signal so as to be discharged in the form of fluid ink, or an ink which is liquified only after heat energy is supplied, e.g., an ink which starts to solidify when it reaches a recording medium, can be adapted to the present invention. In the above case, the ink may be of a type which is held as fluid or solid material in a recess of a porous sheet or a through hole at a position to face the electrothermal converter as disclosed in Japanese Patent Laid-Open No. 54-56847 or Japanese Patent Laid-Open No. 60-71260. It is the most preferred way for the ink to be adapted to the above film boiling method.

The print apparatus of the present invention may take the form of an image output terminal integrally or separately provided for information processing equipment such as a computer, a copying machine combined with a reader or the like, or a facsimile apparatus having a transmission/reception function.

As many apparently widely different embodiments of the present invention can be made without departing from the spirit and scope thereof, it is to be understood that the invention is not limited to the specific embodiments thereof except as defined in the appended claims.

What is claimed is:

1. An ink-jet print method of printing an image on a recording medium by discharging an ink from a print head, comprising the step of:

printing a sub image in a predetermined place other than an effective area of the image for determining change of quality of the image over time, wherein the sub image is printed by using an image preservation determination ink.

2. The method according to claim 1, wherein the image preservation determination ink contains an organic dye as a coloring material.

3. The method according to claim 1, wherein the recording medium has a porous ink-receiving layer on a surface thereof, and a transmittance of not less than 50%.

4. The method according to claim 3, wherein the porous ink-receiving layer contains at least one of alumina and silica.

5. The method according to claim 4, wherein the porous ink-receiving layer contains pseudo-boehmite.

6. The method according to claim 1, wherein the image preservation determination ink has a higher degree of deterioration than an ink used to print the image in the effective area.

7. The method according to claim 6, wherein the image preservation determination ink is lower in resistance to light than the ink used to print the image in the effective area.

8. An ink-jet print apparatus for printing an image on a recording medium by discharging an ink from a print head, comprising:

print means for printing a sub image in a predetermined place other than an effective area of the image for determining change of quality of the image over time, wherein said print means prints the sub image by using an image preservation determination ink.

9. The apparatus according to claim 8, wherein the image preservation determination ink has a higher degree of deterioration than an ink used to print an image in the effective area.

10. The apparatus according to claim 9, wherein the image preservation determination ink is lower in resistance to light than the ink used to print the image in the effective area.

11. An ink-jet print comprising:

a medium on which an image is printed with an ink discharge from a print head, wherein a sub image for determining information preservation is printed on said medium in a predetermined place other than an effective area of the image by using an image preservation determination ink.

12. The ink-jet print according to claim 11, wherein the image preservation determination ink has a higher degree of deterioration than an ink used to print the image in the effective area.

13. The ink-jet print according to claim 12, wherein the image preservation determination ink is lower in resistance to light than the ink used to print the image in the effective area.

14. An ink-jet print apparatus for printing an image on a recording medium by discharging an ink from a print head, comprising:

print means for printing a sub image for determining image preservation with an image preservation determination ink in a predetermined place other than an effective area of an image; and image preservation determination means, having a detection unit comprised of at least a light-emitting element and a light-receiving element, for determining preservation of the image, wherein said image preservation determination means determines preservation of the image based on an optical density or a color difference of the sub image printed with the image preservation determination ink.

15. A method of determining image preservation, comprising the steps of:

printing an image on an image print area on a recording medium by using a first printing material;

printing an image for determining image preservation on a border portion as an area other than the image print area by using a second printing material which deteriorates faster than the first printing material; and optically detecting the image for determining image preservation on the border portion and determining whether the image has deteriorated.

16. A print apparatus for printing an image on a recording medium, comprising:

first print means for printing an image on an image print area on said recording medium; and second print means for printing a sub image for determining image preservation on a portion other than the image print area by discharging an ink from a print head.

17. An apparatus for determining image deterioration, comprising:

reading means for reading an image printed on a printing medium; and determination means for determining a degree of change of quality over time of the image read by said reading means, wherein said reading means reads the image printed on a predetermined location other than an effective area of the image on the printing medium by using an image preservation determination ink.

18. The apparatus according to claim 17, wherein said determination means determines the degree of change of quality of the image over time based on an optical density and/or color difference of the image.

19. The apparatus according to claim 18, further comprising storage means for storing a first value based on the optical density and/or color difference of the image which has been previously read by said reading means, wherein said determination means determines the degree of change of quality of the image over time by comparing the first value with a second value based on an optical density and/or color difference of the image currently read by said reading means.

20. The apparatus according to claim 17, further comprising storage means for storing a first value based on an optical density and/or color difference of the image which has been previously read by said reading means, wherein said determination means determines the degree of change of quality of the image over time by comparing the first value with a second value based on an optical density and/or color difference of the image currently read by said reading means.

21. An apparatus for determining an image used for medical examination, comprising:

reading means for reading an image printed on a printing medium; and determination means for determining a degree of change of quality over time of the image read by said reading means, wherein said reading means reads the image printed on a predetermined location other than an effective area of the image on the printing medium by using an image preservation determination ink.

22. The apparatus according to claim 21, wherein said determination means determines the degree of change of quality of the image over time based on an optical density and/or color difference of the image.

23. The apparatus according to claim 22, further comprising storage means for storing a first value based on the optical density and/or color difference of the image which has been previously read by said reading means, wherein said determination means determines the degree of change of quality of the image over time by comparing the first value with a second value based on an optical density and/or color difference of the image currently read by said reading means.

24. The apparatus according to claim 23, further comprising search means for searching a predetermined medium from a plurality of mediums, wherein an image is printed on an effective area of each of the plurality of mediums.

25. The apparatus according to claim 23, further comprising output means for outputting a warning when said determination means determines that the degree of change of quality of the image over time is greater than a predetermined value.

26. The apparatus according to claim 23, further comprising reproducing means for reproducing the image when said determination means determines that the degree of change of quality of the image over time is greater than a predetermined value.

27. The apparatus according to claim 21, further comprising storage means for storing a first value based on an optical density and/or color difference of the image which has been previously read by said reading means, wherein said determination means determines the degree of the change of quality of the image over time by comparing the first value with a second value based on an optical density and/or color difference of the image currently read by said reading means.

28. The apparatus according to claim 27, further comprising search means for searching a predetermined medium from a plurality of mediums, wherein an image is printed on an effective area of each of the plurality of mediums.

29. The apparatus according to claim 27, further comprising output means for outputting a warning when said determination means determines that the degree of change of quality of the image over time is greater than a predetermined value.

30. The apparatus according to claim 27, further comprising reproducing means for reproducing the image when said determination means determines that the degree of change of quality of the image over time is greater than a predetermined value.

* * * * *

UNITED STATES PATENT AND TRADEMARK OFFICE

CERTIFICATE OF CORRECTION

PATENT NO. : 6,457,799 B1
DATED : October 1, 2002
INVENTOR(S) : Kanome et al.

It is certified that error appears in the above-identified patent and that said Letters Patent is hereby corrected as shown below:

Column 1,
Line 7, “a” should read -- to a --.
Line 26, “multi gradation” should read -- multigradation --.

Column 3,
Line 62, “loses,” should read -- loess, --.

Column 4,
Line 24, “monometyletheracetate, dietylene” should read
-- monomethyletheracetate, diethylene --.

Column 5,
Line 14, “$MH_2O$” should read -- $mH_2O$ --.
Line 25, “hydrolizing” should read -- hydrolyzing --.

Column 6,
Line 60, “having” should read -- head having --.

Column 7,
Line 23, “slid ably” should read -- slidably --.

Column 10,
Line 60, “CF-301” should read -- CF-F301 --.

UNITED STATES PATENT AND TRADEMARK OFFICE

CERTIFICATE OF CORRECTION

PATENT NO. : 6,457,799 B1
DATED : October 1, 2002
INVENTOR(S) : Kanome et al.

It is certified that error appears in the above-identified patent and that said Letters Patent is hereby corrected as shown below:

Column 11,
Line 61, “take place” should read -- bring about --.

Signed and Sealed this

Twenty-seventh Day of May, 2003

JAMES E. ROGAN
*Director of the United States Patent and Trademark Office*